US005208844A

United States Patent [19]

Puthoff et al.

[11] Patent Number: 5,208,844

[45] Date of Patent: May 4, 1993

[54] ELECTRONIC DEVICES USING DISCRETE, CONTAINED CHARGED PARTICLE BUNDLES AND SOURCES OF SAME

[75] Inventors: Harold E. Puthoff, Austin; George W. Church, Jr., San Antonio; David B. Clifton, Leander; Scott R. Little, all of Tex.

[73] Assignee: Jupiter Toy Company, Austin, Tex.

[21] Appl. No.: 702,467

[22] Filed: May 20, 1991

[51] Int. Cl.[5] ..... H01J 1/46

[52] U.S. Cl. ..... 378/122; 378/114; 378/119

[58] Field of Search ..... 378/119, 121, 122, 136, 378/143, 101-107, 114; 313/130, 131 R, 131 A, 306, 308, 336; 328/59, 63-68

[56] References Cited

U.S. PATENT DOCUMENTS 4,656,430 4/1987 Olson ..... 328/64
4,972,420 11/1990 Villa ..... 372/2
5,018,180 5/1991 Shoulders .
5,054,046 10/1991 Shoulders ..... 378/119
5,054,047 10/1991 Shoulders ..... 378/119

*Primary Examiner*—David P. Porta
*Attorney, Agent, or Firm*—Lowe, Price, LeBlanc & Becker

[57] ABSTRACT

Discrete, contained charged particle bundles are converted into heat energy for driving a load. In one embodiment the bundles propagate between a cathode and anode in a gap between a pair of solid dielectric members, which gap has a dimension between a pair of facing surfaces of the dielectric members equal approximately to the diameter of a group of such bundles propagating together. The bundles are derived in response to high voltage short duration pulses derived from a modified Blumlein switch. The bundles are periodically derived and converted to current that flows in a circuit having a resonant frequency equal to the frequency of the bundles. In another embodiment the bundles are derived from a cathode including a liquid metal pool in contact with a solid dielectric surface along which the bundles propagate to an x-ray emitting target or an anode that is heated by the bundles, to convert the x-rays into useful emission and/or the heat into useful work.

59 Claims, 5 Drawing Sheets

ELECTRONIC DEVICES USING DISCRETE, CONTAINED CHARGED PARTICLE BUNDLES AND SOURCES OF SAME

RELATION TO CO-PENDING APPLICATION

The present invention is an improvement on the subject matter of co-pending, commonly assigned application Ser. No. 07/347,262, filed May 3, 1989, for ENERGY CONVERSION USING HIGH CHARGE DENSITY, now U.S. Pat. No. 5,018,180, issued on May 21, 1991, a continuation-in-part of Ser. No. 07/183,506, filed May 3, 1988, entitled PRODUCTION AND MANIPULATION OF HIGH CHARGE DENSITY, abandoned in favor of Ser. No. 07/523,294, filed May 14, 1990, in turn a continuation-in-part of Ser. No. 07/137,244, for PRODUCTION AND MANIPULATION OF HIGH CHARGE DENSITY, filed Apr. 6, 1988, abandoned in favor of Ser. No. 07/523,295, filed Jun. 13, 1990.

FIELD OF THE INVENTION

The present invention relates generally to devices using and sources of discrete, contained charged particle bundles. In one particular aspect of the invention, such bundles are converted into heat energy for driving a load. In accordance with a further aspect of the invention, such bundles propagate between a cathode and anode in a gap through a solid dielectric means, which gap has a dimension between a pair of facing surfaces of the dielectric means equal approximately to the diameter of a group of such bundles propagating together. In accordance with a further aspect of the invention, such bundles are derived in response to high voltage short duration pulses derived from a modified Blumlein switch. In accordance with another aspect of the invention, such bundles are periodically derived and converted to current that flows in a circuit. In accordance with a further aspect of the invention, such bundles are derived from a cathode including a liquid metal pool in contact with a solid dielectric surface.

BACKGROUND ART

In the aforementioned co-pending, commonly assigned applications, all of which are invented by Kenneth R. Shoulders, there are disclosed various sources and devices wherein discrete, contained charged particle bundles are derived and propagate to various devices. In a particular cross-section of a propagation path, a group of such bundles are simultaneously present. The group of bundles is similar, in the cross section, to a key chain or necklace. Each bundle has a configuration similar to a sphere and is approximately equi-spaced from a center point of the bundle group. It is believed that the charged particles in each bundle are predominantly electrons and that each bundle has a density approaching that of a solid.

The bundles are derived in the prior art device by locating a cathode and counterelectrode, i.e., anode, on a solid dielectric. Voltage is applied between the anode and cathode, causing a group of bundles to propagate in a slot on a surface of the dielectric between the anode and cathode. In one embodiment, the cathode is a metal wire wetted by mercury. The prior art indicates that x-rays are derived by causing such bundles to propagate through a vacuum to an x-ray target which emits the x-rays from a face of the target opposite from a face of the target on which the bundles are incident. Conversion of energy is also disclosed in the aforementioned prior art by causing the bundles to traverse a slow wave structure, similar to a slow wave structure of the type employed in a travelling wave tube. The prior art also indicates that electromagnetic energy can be radiated by applying such bundles to a slot configured as an undulating wave.

The discrete, contained charged particle bundles are derived in response to a discharge voltage being established between the anode and cathode along the solid dielectric surface. The cathode, anode, solid dielectric and voltage are apparently such that an image charge is established on the solid dielectric. The image-charged solid dielectric causes the discrete, contained charged particle bundles to propagate along a path defined by the slot in the dielectric surface.

THE INVENTION

The present invention relates to improvements of various types to sources for deriving and devices for using discrete, contained charged particle bundles of the type disclosed in the aforementioned applications. The present invention is applicable to electronic devices comprising a cathode, an anode and a dielectric interposed between the cathode and anode so that a path subsists along the dielectric between the cathode and anode in combination with a pulsed voltage source connected between the anode and cathode. The pulsed voltage source, anode and cathode are such that a discrete contained charged particle bundle is formed at the cathode to propagate along the path to the anode.

In accordance with one feature of the invention the pulsed voltage source is a modified Blumlein switch including a DC power supply and a capacitor having first, second and third electrodes. The first electrode is located between the second and third electrodes and is connected to the DC power supply to be charged by the supply. The second and third electrodes are respectively connected to the cathode and anode. A coil is connected across the second and third electrodes. The first electrode is selectively connected by a spark gap breakdown discharge to one of the second and third electrodes to establish a second discharge including a discrete contained charged particle bundle between the cathode and anode.

In accordance with a further feature, the cathode, anode and a solid dielectric interposed between the cathode and anode are located in a chamber having a vacuum or an inert dielectric gas therein. The cathode and anode contact different portions of the dielectric. A high voltage short duration pulse source is connected between the anode and cathode. The anode, cathode, solid dielectric and duration and voltage of pulses from the source are such that in response to a pulse from the source being applied between the anode and cathode, a discrete contained charged particle bundle is formed at the cathode and propagates along a surface of the dielectric thence around the dielectric to the anode.

In one of the preferred embodiments, the solid dielectric and anode are configured as plates having abutting faces such that a portion of the solid dielectric plate overhangs an edge of the anode plate and a portion of the anode plate overhangs the solid dielectric plate. The cathode is positioned: (a) on a face of the solid dielectric opposite the abutting faces, (b) adjacent the overhanging portion of the solid dielectric, and (c) so that the thickness of the solid dielectric is interposed between the anode and cathode. The voltage, anode, cathode and solid dielectric are arranged so that the bundle propagates from the cathode along the solid dielectric face opposite the abutting faces to an edge of the solid dielectric and thence across said edge to the anode.

A further feature of the invention is that the cathode includes a liquid metal pool. For devices having solid dielectrics the path subsists across a surface of the dielectric, the liquid metal pool contacting the surface of the dielectric. In the preferred embodiment the liquid metal is mercury located in a dielectric cup including a terminal contacting the pool; however, other liquid metals such as gallium or other alloys may be used.

In accordance with another aspect of the invention an electronic device comprises a source of periodic discrete contained charged particle bundles having a predetermined frequency, in combination with a circuit connected to the source so that periodic current at the predetermined frequency resulting from derivation of the periodic discrete contained charged particle bundles flows in the circuit. Preferably the source includes: an anode, cathode and solid dielectric interposed between the anode and cathode, and a high voltage source for deriving pulses at the predetermined frequency connected between said anode and cathode. The circuit is connected in series with the anode, cathode and solid dielectric and is a tuned circuit having a resonant frequency equal to the predetermined frequency.

In accordance with a further feature, an energy converter comprises a source of discrete contained charged particle bundles traversing a path, in combination with means in the path for collecting the charged particle bundles and absorbing heat in response to the charged particle bundles being incident thereon. Means responsive to the heat absorbed by the absorbing means performs useful work.

Preferably the source of the energy converter includes a cathode, anode and a solid dielectric interposed between the cathode and anode. The solid dielectric has a surface traversed by the charged particle bundles to define the path. The anode comprises the means for collecting and is formed of a metal that is substantially non-radiative of thermal and electromagnetic energy in response to the bundles being incident thereon. The anode includes a passage through which heat exchange fluid flows to be heated by the heat absorbed by the anode from the bundles.

In one embodiment of the energy converter, the solid dielectric includes an elongated gap defining a path for a group of the particles propagating simultaneously from the cathode to the anode. The group of particles has a predetermined diameter equal approximately to a dimension of the gap at right angles to the path. In this embodiment the cathode includes an edge substantially at right angles to the path and substantially aligned with the path. The anode includes a wall substantially at right angles to the path; the wall intercepts the path and therefore the bundle. The cathode is preferably configured as a disc having an axis so that said edge is a circumferential edge of the disc. The anode wall has a circular configuration coaxial with the axis and surrounding the edge. The gap is configured as a ring between the edge and wall.

According to still another feature of the invention the dielectric is a solid dielectric interposed between the cathode and anode. The solid dielectric includes an elongated gap defining the path for the group of discrete contained charged particle bundles. The gap has a dimension at right angles to the path equal approximately to the diameter of the group.

A further feature of the invention relates to an x-ray source comprising a cathode, an anode and a solid dielectric interposed between the cathode and anode so that a path subsists across a surface of the dielectric between the cathode and anode, in combination with a voltage source connected between the anode and cathode. The voltage source, anode and cathode are such that a discrete contained charged particle bundle is formed at the cathode and propagates along the surface of the dielectric to a predetermined surface region of the anode to be incident on the surface at a predetermined angle of incidence. The predetermined region of the anode is made of a material and is arranged so that x-rays are emitted from the surface of the region at an angle generally opposite to the predetermined angle of incidence. The cathode, anode and solid dielectric are located in a vacuum chamber including (a) means for transmitting out of the chamber x-rays emitted from the anode to be incident on a workpiece exterior to the chamber, and (b) an x-ray film holder positioned to be responsive to x-rays emitted from the anode for calibration purposes.

It is, accordingly, an object of the present invention to provide new and improved sources of discrete, contained charged particle bundles.

Another object of the invention is to provide a new and improved x-ray source using discrete, contained charged particle bundles, which source is relatively small, inexpensive and capable of producing very small, high resolution x-ray spots.

An additional object of the present invention is to provide a new and improved high efficiency energy converter using discrete, contained charged particle bundles, wherein energy in the bundles is transferred to heat.

Still another object of the invention is to provide a periodic source of discrete, contained charged particle bundles, wherein the bundles have a predetermined frequency and are converted to current that is applied to a circuit.

The above and still further objects, features and advantages of the present invention will become apparent upon consideration of the following detailed description of several embodiments thereof, especially when taken in conjunction with the accompanying drawings.

DESCRIPTION OF THE DRAWING

Figure 1:
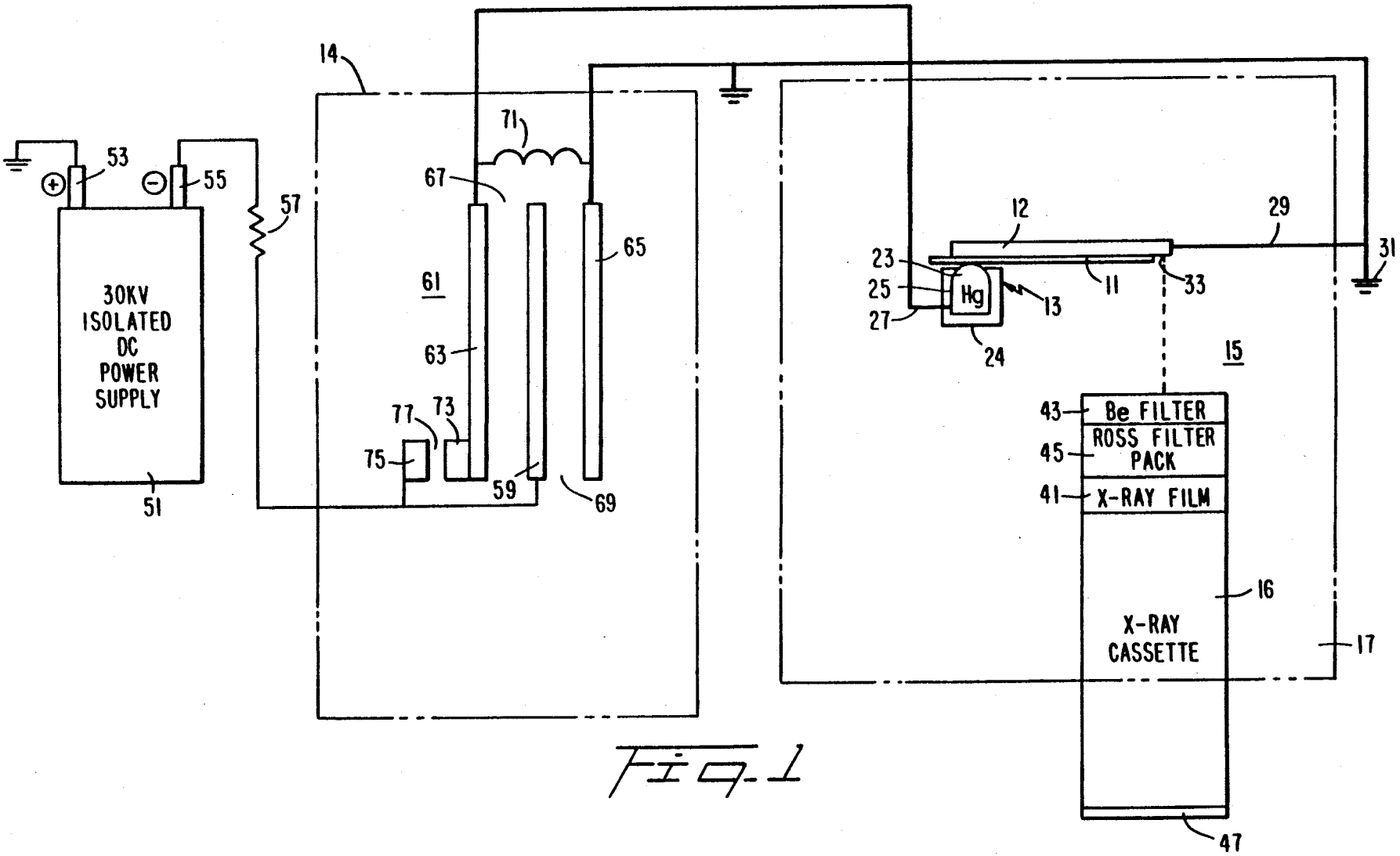
FIG. 1 is a schematic diagram of a preferred embodiment of an x-ray source in accordance with the present invention, wherein discrete, contained charged particle bundles are derived from an improved source including a modified Blumlein switch, a cathode formed of a mercury pool, and a solid dielectric positioned relative to the cathode and an anode.

Reference is now made to FIG. 1 of the drawing, an x-ray source including solid dielectric sheet 11, anode or counterelectrode 12 and cathode 13. High voltage short duration pulses are applied by pulse source 14 between anode 12 and cathode 13 to cause discrete, contained charged particle bundles to propagate from the cathode to the anode. In response to the charged particles being incident on anode, i.e., target, electrode 12, x-rays are emitted from the target so that the x-rays propagate from the target at an angle generally opposite from the angle of incidence of the charged particles on the target. The x-rays can be directed to an article, i.e., workpiece, in region 15, or, via an appropriate window, to a workpiece outside of the chamber, or be incident on x-ray cassette 16 for calibration purposes. Dielectric sheet 11, anode 12, cathode 13, region 15 and cassette 16 are located in vacuum chamber 17, typically maintained at a vacuum of about $10^{-6}$ Torr.

Cathode 13 includes dielectric cup 21, filled with mercury (or other liquid metal) pool 23 that extends, somewhat as a globule, above the top edge of the cup so that the mercury in the pool abuts against a planar face of dielectric sheet 11, preferably fabricated of quartz. Cup 21 includes terminal 25 that is in intimate contact with mercury pool 23. Heavy copper strap 27 sealingly extends through cup 21 and is soldered to terminal 25 so that a very low electrical resistance subsists between pool 23 and strap 27.

Counterelectrode or anode 12, configured as a plate, abuts against the face of dielectric sheet 11 opposite to the face of the dielectric sheet against which mercury pool 23 abuts. Anode 12 has an area somewhat smaller than the area of dielectric sheet 11 such that the length of plate 12 is less than the length of sheet 11 and the width of plate 12 is slightly less than the width of sheet 11. The entire area of electrode 12 abutting against sheet 11 is covered by the sheet, except for a small portion on one side of the electrode which extends beyond the sheet (in FIG. 1, the extending side of plate electrode 12 is to the right of sheet 11). Sheet 11 includes an edge which extends considerably beyond a corresponding edge of anode 12 (illustrated in FIG. 1, as the left edges of the sheet and electrode). Cathode 13 is arranged so that the contact region between mercury pool 23 and dielectric sheet 11 is toward the edge of sheet 11, where the sheet extends beyond anode 12. The breakdown strength and thickness of dielectric of sheet 11 and the voltage of source 14 applied to anode 12 and cathode 13 are such that breakdown does not occur between the anode and cathode through the sheet when the voltage is applied to the anode and cathode. It has been found that a quartz sheet having a thickness of three mils provides the desired characteristics; it is to be understood that other suitable dielectric materials, e.g., KAPTON, can be used. Anode 12 is connected by heavy copper strap 29 to ground terminal 31.

In response to a short duration, negative high voltage pulse being applied by pulse source 14 to lead 27, a group of discrete, contained charged particles, as illustrated in FIG. 61 of the aforementioned applications, propagates from the contact region of mercury pool 23 with dielectric sheet 11 to region 33 of anode 12 that projects beyond the edge of dielectric sheet 11. Anode 12 is fabricated of an x-ray emissive material, such as aluminum, vanadium, copper, tungsten, molybdenum or titanium to produce bremsstrahlung, and characteristic target radiations In response to the group of discrete, contained charged particles from cathode 13 being incident on region 33, x-rays are emitted from region 33 and propagate through region 15. The x-ray flux density is approximately $10^{13}$ photons per 10 nanoseconds in the 3 to 250 Kev range.

In one preferred use of the invention, the x-rays emitted from region 33 provide x-rays for fine line (submicron) x-ray lithography, or for inspection of integrated circuit patterns on integrated circuits.

In FIG. 1, x-rays from region 33 are calibrated by being coupled to be incident on x-ray film 41 in light tight x-ray cassette 16. Cassette 16 includes pinhole-free beryllium window 43, having a thickness of about 5 mils. Window 43 has virtually 100 percent transmittivity to the low energy x-rays emitted from region 33 of anode 12. Window 43 is opaque to visible light, as well as other optical energy, and provides a seal for the remainder of cassette 16 so that air in the cassette is prevented from flowing into vacuum chamber 15. Interposed between beryllium window 43 and x-ray film or plate 41 is Ross filter pack 45. Cassette 16 is a completely light tight enclosure including removable end cap 47, at an end of the cylindrical cassette opposite from window 43, for enabling the x-ray film to be inserted into the cassette.

Figure 1A:
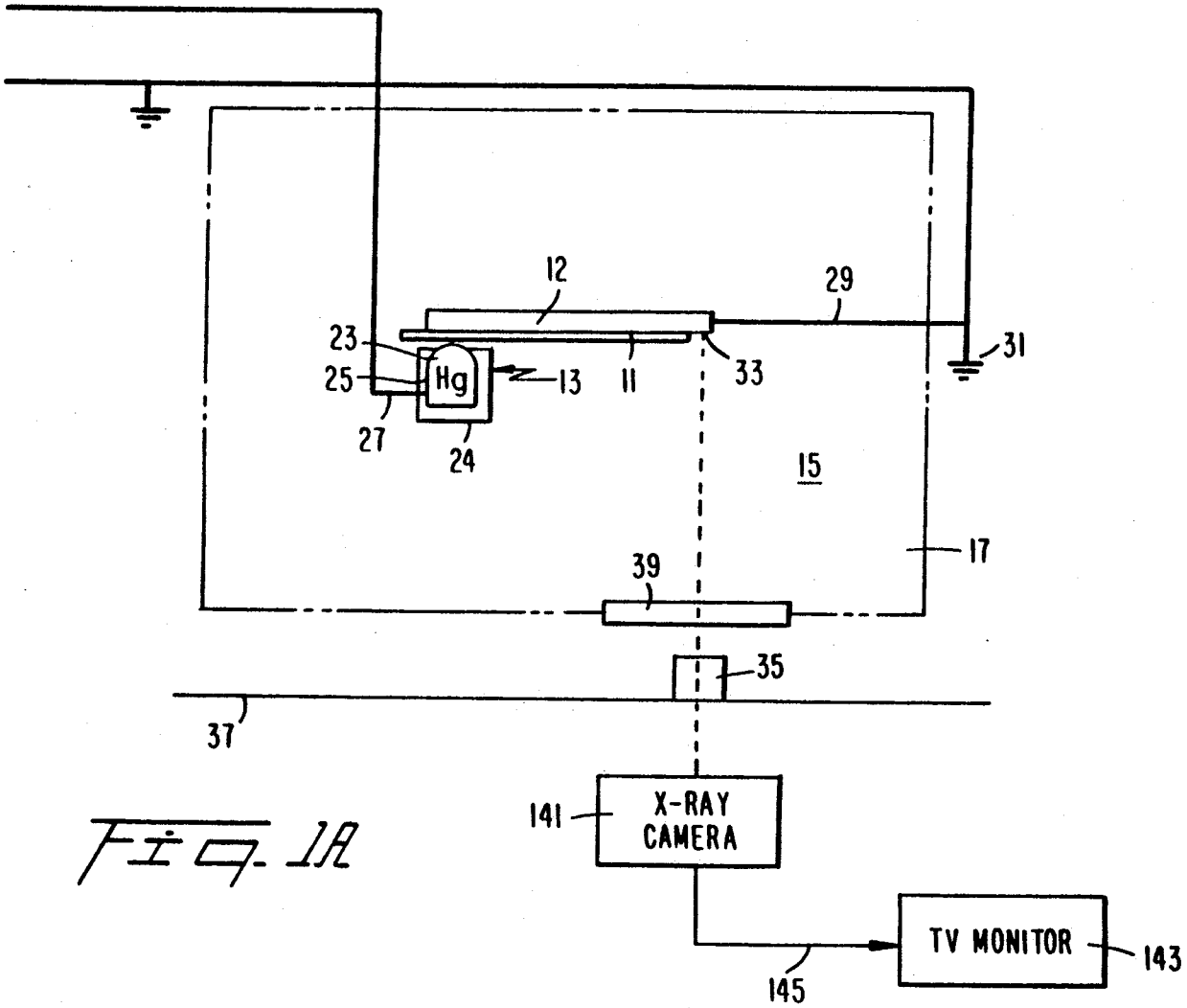
FIG. 1*a* is a drawing of a modification of a portion of the device illustrated in FIG. 1, for use in monitoring the characteristics of workpieces.

In FIG. 1*a*, the x-rays from region 33 are used to inspect integrated circuit patterns on integrated circuits 35 that are transported outside of vacuum chamber 17 by conveyor 37. X-rays from region 33 are incident on circuits 35 after passing through pinhole-free beryllium window 39 in the chamber. The x-rays from region 33 of anode 12 incident on integrated circuits 35 have a sufficiently small spot size to enable defects in integrated circuits 35 to be detected. The x-rays, after passing through circuits 35, are incident on x-ray television camera 141 which derives a video signal that is supplied to television monitor 143 via cable 145.

To enable the discrete, contained charged particle bundles, which are believed to be predominantly electrons having a density approximately that of a solid, to propagate from cathode 13 to region 33 on dielectric 11, extremely sharp, high current pulses having a duration of 10 nanoseconds or less are coupled to heavy copper straps 27 and 29 by pulse source 14. Pulse source 14, a modified Blumlein switch, includes high voltage (30 kilovolts) isolated DC power supply 51, having positive grounded electrode 53 and negative electrode 55 connected through large valued resistor 57 (e.g., 50 megohms) to copper electrode plate 59 of capacitor 61. Capacitor 61 includes copper electrode plates 63 and 65, having the same area as plate 59; plates 63 and 65 are equi-spaced on opposite sides from plate 59 so that all three plates are in mutually parallel planes Air gaps 67 and 69 subsist between plates 59 and 63 and plates 59 and 65, respectively. Various solid dielectrics such as LEXAN and KAPTON, can replace air gaps 67 and 69 and combinations of the solid dielectrics and the air gaps can be used. The spacing between plates 59 and 63, as well as between plates 59 and 65, is variable, to provide adjustment of air gaps 67 and 69. Plates 59, 63 and 65 are movable with respect to each other through the use of appropriate spacers and clamps. By changing the air gap distance between plates 59, 63 and 65, the capacitance of capacitor 61 can easily be varied between 100–2000 picofarads. Plates 63 and 65 are connected together by pulse shaping inductor 71 (e.g., 1 microhenry). Plates 59 and 63 are selectively connected together by a spark gap breakdown discharge between contacts 73 and 75, between which is provided adjustable spark gap 77.

In operation, current from DC power supply 51 causes a negative voltage to be applied to central plate 59. Plates 63 and 65 are maintained at ground potential while plate 59 is being charged through resistor 57 by the −30 kilovolt voltage level at terminal 55 of power supply 51 by virtue of inductor 71 being a short circuit for DC purposes. Thereby, depending on when spark gap 77 breakdown discharge occurs, a potential difference of some kilovolts builds between plate 59 and each of plates 63 and 65.

Figure 2:
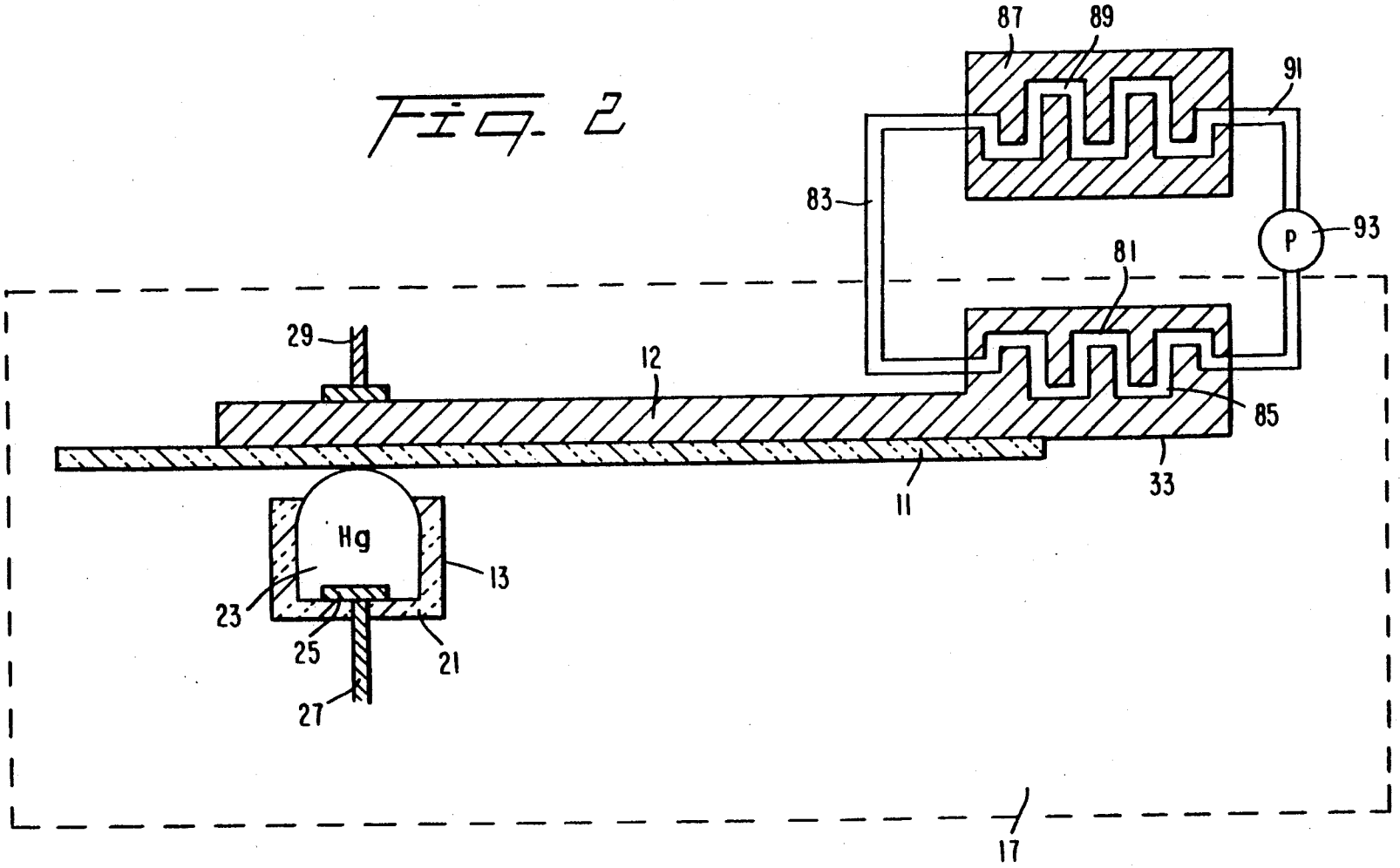
FIG. 2 is an energy converter in accordance with a preferred embodiment of the invention.

To provide extremely sharp, high-current pulses having a duration of 10 nanoseconds or less, contacts 73 and 75 are effectively closed by a discharge breakdown in spark gap 77, causing the voltage on plate 59 to be transferred through contacts 73 and 75 to plate 63. This causes an extremely sharp high negative current to flow via strap 27 to terminal 25 and mercury pool 23. A discharge is thereby established from the contact region of pool 23 to the area of sheet 11 in contact with pool 23, across the face of the sheet contacting the pool, and around the edge of sheet 11 to region 33. The current is quickly extinguished as a result of the resonant nature of the Blumlein switch including capacitor 61 and inductor 71. Thereafter contacts 73 and 75 open by virtue of the breakdown discharge in spark gap 77 being extinguished. The Blumlein switch provides very rapid discharge of the charge established between plates 59, 63 and 65, and ensures accurate setting of the peak pulse voltage and the amount of charge delivered from capacitor 61 to cathode 13 and anode 12. Reference is now made to FIG. 2 of the drawing, wherein the apparatus illustrated in FIG. 1 is modified to be an energy converter. In particular, the electric energy of DC power supply 51 is converted into discrete, separate charged particle bundles that propagate from cathode 13, along dielectric sheet 11 into contact with region 33 of anode 12. At region 33, the discrete, charged particle bundles are converted into heat which is transferred to a heat transfer fluid that heats a suitable load.

To these ends, anode 12 is fabricated of a metal, e.g., steel, that absorbs, without significant radiation, the energy in the charged particle bundles incident on region 33. Anode 12 includes an enlarged volume 81 in the vicinity of region 33. Volume 81 is heated to a high temperature as a result of the charged particle bundles being incident on region 33. The heat in region 81 is transferred to heat transfer fluid that flows in conduit 83, connected to passage 85 in volume 81. To enhance heat transfer between volume 81 and the fluid in conduit 85, the conduit is shaped as a tortuous path.

Useful work is extracted from thermal load 87, including passage 89 that is shaped as a tortuous path to increase heat transfer efficiency. Passage 89 has an inlet connected to conduit 83. Conduit 91 is connected between passages 85 and 91 to supply the cool heat transfer fluid flowing out of passage 89 to passage 85, with the assistance of pump 93. It has been found that the electric energy from power supply 51 is very efficiently transferred to heat in volume 81 and to the useful work performed by thermal load 87.

Dielectric sheet 11, anode 12, cathode 13 and the components associated therewith, as well as portions of conduits 83 and 91, are located in chamber 17 that is evacuated to a vacuum condition, e.g., $10^{-6}$ Torr. Alternatively, chamber 17 contains a low pressure (e.g., $10^{-3}$ Torr) inert gas, such as argon or xenon, that aids the discharge between cathode 13 and region 33 each time a group of discrete charged particles propagates between the cathode and anode region.

Figure 3:
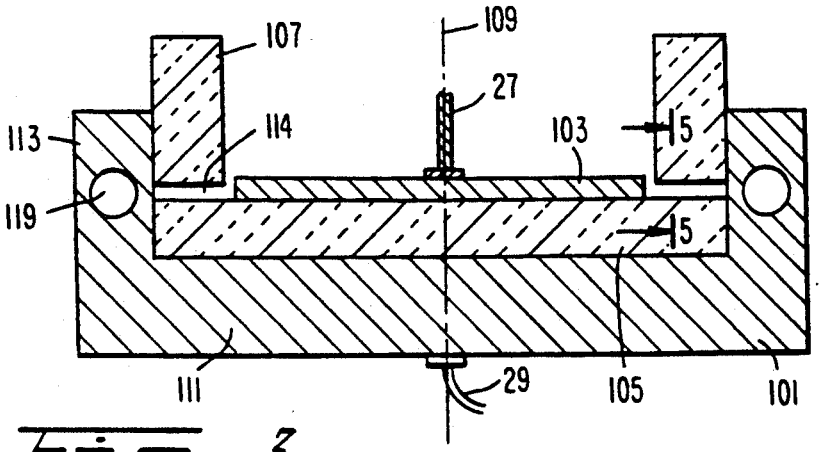
FIG. 3 is a side view of another embodiment of an energy converter in accordance with the present invention wherein a group of discrete, contained charged particle bundles propagates through a gap between a pair of endfaces of a solid dielectric means, wherein the gap has a height approximately equal to the diameter of the group of bundles.
Figure 4:
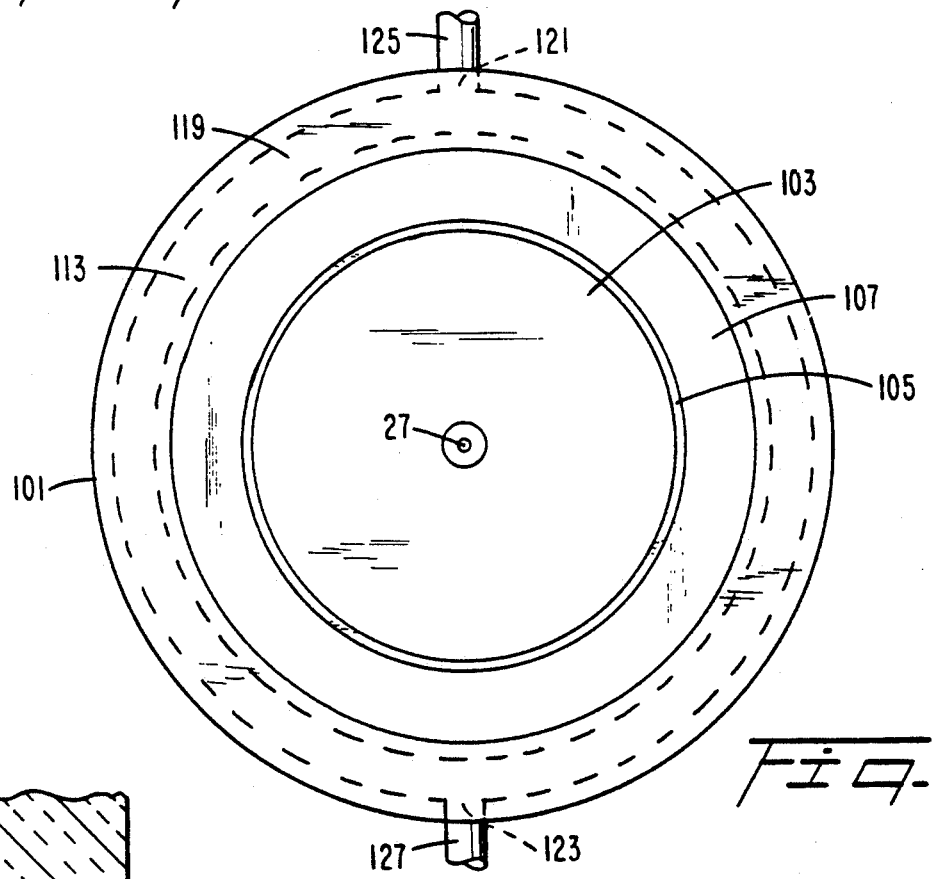
FIG. 4 is a top view of the energy converter illustrated in FIG. 3.
Figure 5:
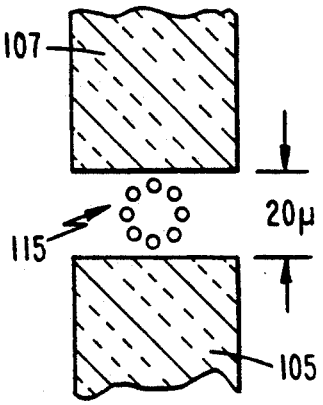
FIG. 5 is a cross-sectional view of the gap and the group of bundles of the energy converter illustrated in FIG. 3.

A further embodiment of an energy converter in accordance with the present invention is illustrated in FIGS. 3–5. The structure illustrated in FIGS. 3–5 is enclosed in a chamber subjected to a vacuum or a low pressure inert gas, as described in conjunction with FIG. 2. The energy converter of FIGS. 3–5 includes an anode and cathode preferably energized by high current pulses from a power supply of the type illustrated in connection with FIG. 1.

The structure of FIGS. 3–5 includes metal anode 101, cathode disk 103, solid dielectric, electric insulator disk 105 and solid dielectric ring 107. Anode 101 and cathode 103 are respectively connected by heavy copper straps 27 and 29 to a modified Blumlein switch, as described supra. Anode 101, cathode 103, dielectric disk 105 and ring 107 are coaxial with axis 109. Anode 101 is configured as a tube having base 111 and stub side wall 113. Tube 111 is manufactured of a non-radiative metal, such as steel, that absorbs discrete, contained charged particle bundles emitted from cathode disk 103. Disk 105 has a lower face abutting against the upper face of base 111 of tube 101. Disk 105 is fabricated of a dielectric having a high dielectric constant and high breakdown strength; in one embodiment, disk 105 is fabricated from KAPTON, a polyimide. Insulator disk 105 includes a sidewall or edge that fits snugly in side wall 113.

Cathode disk 103, preferably fabricated of one of molybdenum, titanium or brass, has a lower edge that abuts against the upper edge of dielectric disk 105. The stated metals are the preferred materials for cathode disk 103 because they are either tough, to resist erosion in response to a discharge between cathode disk 103 and anode 101, or are self-smoothing in response to the discharges. Cathode disk 103 has a diameter considerably less than the diameter of dielectric disk 105 so that the circumference of disk 103 is slightly less than the inner diameter of dielectric ring 107.

Dielectric ring 107 is positioned between the circumferential edge of disk 103 and the interior edge of wall 113. Ring 107 includes a bottom face that extends parallel to the upper face of disk 105 and is spaced from the disk to form an elongated gap having a height of approximately 20 microns, the diameter of a group of discrete, contained charged particle bundles 115 (FIG. 5) that propagate from the circumferential edge of disk 103 to the interior edge of wall 113.

The particular construction of disk 105 and ring 107 causes the heat energy transferred by the bundles to wall 113 and anode 101 to be retained in the vicinity of wall 113. In addition, the described configuration prevents radiation of energy from wall 113 and anode 101, to enhance efficiency in converting electrical energy to thermal energy.

To enable coulomb and kinetic energy in the discrete contained charged particle bundles incident on wall 113 to be efficiently converted into thermal energy, the wall is provided with bore 119 that is located directly opposite from the impact region of bundle group 115 on wall 113. Passage 119 extends completely around wall 113 to ports 121 and 123. Heat transfer fluid flows from conduit 125 through port 121 to be heated by bundle group 115. The heat transfer fluid flows in an opposite direction through conduit 119, thence through port 123 to conduit 127 to a heat load similar to heat load 87, FIG. 2.

Each time a high voltage pulse is applied to straps 27 and 29, a group of discrete, contained charged particle bundles propagates from a point on the circumferential edge of cathode disk 103 through ring shaped gap 114 to the interior edge of wall 113. The propagation path of each group of bundles is random. However, the same propagation path does not usually occur consecutively because of the tendency for charge to build up and be retained on the surface of disk 105 which has been traversed by a charged bundle. The retained charge establishes a repelling force for the next discrete contained charged particle bundle.

Figure 6:
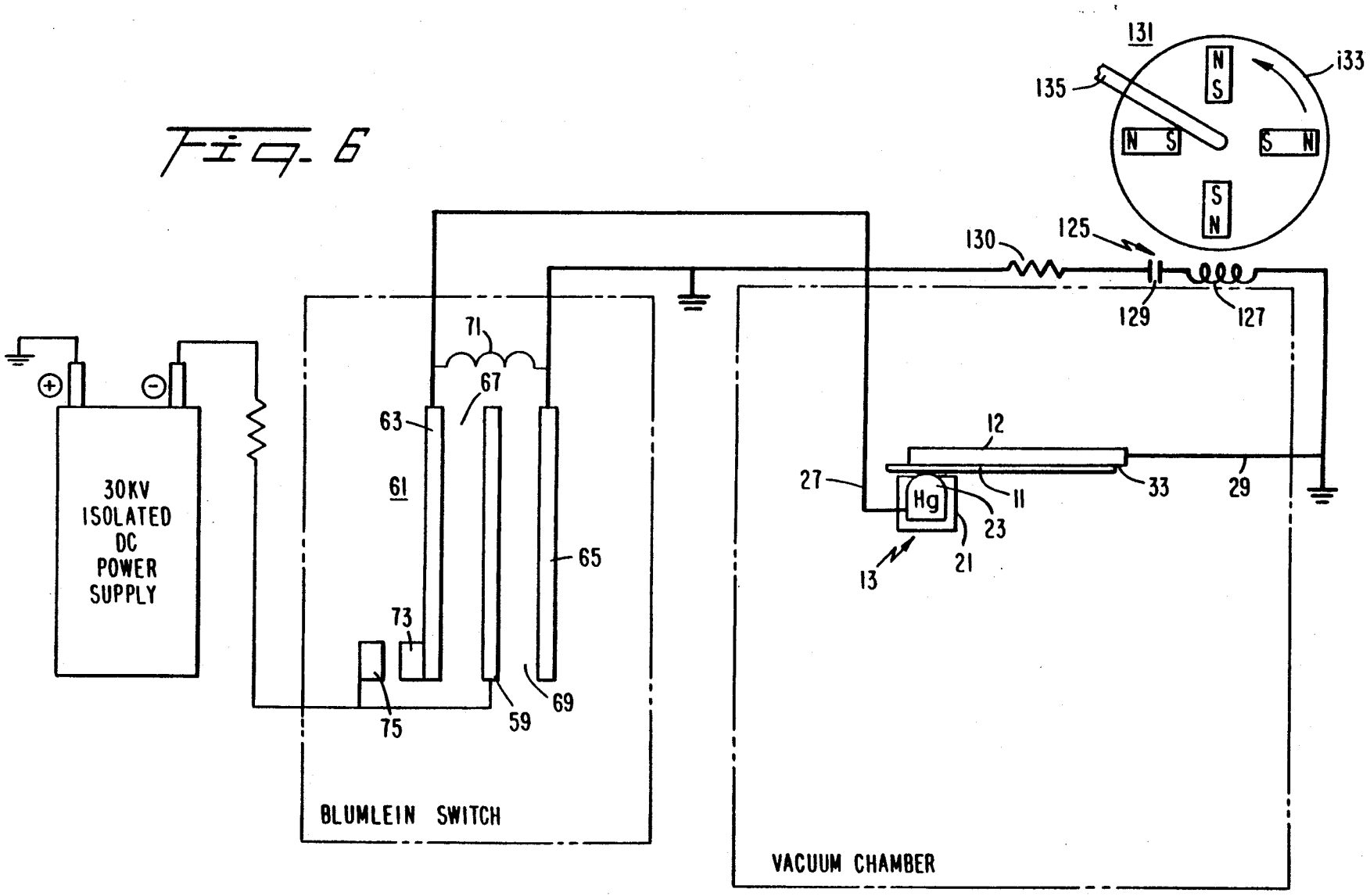
FIG. 6 is a schematic diagram of a periodic source of discrete, contained charged particle bundles driving a resonant circuit having a resonant frequency equal to the frequency of the periodic bundles and including a coil of a permanent magnet step motor.

Reference is now made to FIG. 6 of the drawing, wherein the structure illustrated in FIG. 1 is modified to produce periodic groups of discrete contained charged particle bundles having a predetermined frequency. The bundles are converted to periodic electric current that flows in a resonant circuit having a resonant frequency equal to the frequency of the bundles.

To these ends, contacts 73 and 75 are periodically closed by discharge breakdown in spark gap 77. Each time contacts 73 and 75 are closed by discharge breakdown in spark gap 77, a sharp high current, narrow pulse is supplied to strap 27. Each pulse causes a group of discrete contained charged particle bundles to propagate from cathode 13 to anode 12, causing a current to flow in strap 29, at the frequency at which contacts 73 and 75 are closed. The current pulses flowing in strap 29 are supplied to resonant circuit 125 including load resistance 130 and coil 127, connected in series with capacitor 129. In an embodiment for producing motive power, load resistance 130 is removed and coil 127 is the coil of step motor 131, including permanent magnet armature 133 and output shaft 135. There is a very efficient transfer of energy from power supply 51 to motor 131 as a result of the efficient conversion of energy resulting from the propagation of the discrete contained charged particles from cathode 13 to anode 12, as well as by virtue of the resonating effects of coil 127 and capacitor 129 to the pulses of supply 51.

While there have been described and illustrated several specific embodiments of the invention, it will be clear that variations in the details of the embodiments specifically illustrated and described may be made without departing from the true spirit and scope of the invention as defined in the appended claims.

We claim:

1. An electronic device comprising a cathode; an anode; and a dielectric interposed between the cathode and anode so that a path subsists along the dielectric between the cathode and anode; a pulsed voltage source connected between the anode and cathode; the pulsed voltage source, anode and cathode being such that a discrete contained charged particle bundle is formed at the cathode to propagate along the path to the anode; the pulsed voltage source including: a DC power supply, a capacitor having first, second and third electrodes, the first electrode being located between the second and third electrodes and connected to the DC power supply to be charged by the supply, the second and third electrodes being respectively connected to the cathode and anode, a coil connected across the second and third electrodes, and spark gap breakdown discharge means for selectively connecting the first electrode to one of the second and third electrodes to establish a second discharge including the discrete contained charged particle bundle between the cathode and anode.

2. The device of claim 1 wherein the dielectric is a solid and the path subsides along the surface of the dielectric.

3. The device of claim 2 wherein the cathode includes a liquid metal pool contacting the surface of the solid dielectric.

4. The device of claim 1 wherein the cathode includes a liquid metal pool.

5. The device of claim 1 wherein the anode, cathode and dielectric are in a vacuum chamber and the anode is an x-ray source.

6. The device of claim 5 wherein the chamber further includes means for transmitting out of the chamber x-rays emitted from the anode to be incident on a workpiece exterior to the chamber and a detector for said x-rays as incident on the workpiece.

7. The device of claim 6 wherein the anode is of a type that the x-rays are emitted from a region of the anode that is the same as the region on which the bundle is incident.

8. The device of claim 5 wherein the anode is of a type that the x-rays are emitted from a region of the anode that is the same as the region on which the bundle is incident.

9. The x-ray source of claim 5 further including a vacuum chamber in which the cathode, anode and solid dielectric are located, and including an x-ray film holder positioned to be responsive to x-rays emitted from the anode for calibration purposes.

10. An x-ray source comprising a chamber having a vacuum or an inert dielectric gas therein, the chamber including a cathode, an anode and a solid dielectric interposed between the cathode and anode so that the cathode and anode contact different portions of the dielectric, and a high voltage short duration pulse source connected between the anode and cathode; the anode, cathode, solid dielectric and duration and voltage of pulses from the source being such that in response to a pulse from the source being applied between the anode and cathode, a discrete contained charged particle bundle is formed at the cathode and propagates along a surface of the dielectric thence around the dielectric to the anode, the anode being fabricated of a material that emits x-rays in response to the bundle being incident thereon, the x-rays being emitted from a regions of the anode that is the same as the region on which the bundle is incident.

11. The x-ray source of claim 10 wherein the chamber further includes means for transmitting out of the chamber x-ray emitted from the anode to be incident on a workpiece exterior to the chamber and a detector for said x-rays as incident on the workpiece.

12. The x-ray source of claim 10 further including a vacuum chamber in which the cathode, anode and solid dielectric are located, and including an x-ray film holder positioned to be responsive to x-rays emitted from the anode for calibration purposes.

13. The x-ray source of claim 10 wherein the x-rays have a flux density of approximately $10^{13}$ photons per 10 nanoseconds in the 3 to 250 Kev range.

14. The x-ray source of claim 10 wherein the cathode includes a liquid metal pool in a dielectric container, the pool having sufficient volume so a globule thereof extends out of the container to contact the solid dielectric, the solid dielectric area contacted by the globule having an area greater than the globule contact area therewith and surrounding the area of the globule contacting it.

15. The device of claim 14 wherein the solid dielectric and anode are configured as plates having abutting faces such that a portion of the solid dielectric plate overhangs an edge of the anode plate and a portion of the anode plate overhangs the solid dielectric plate, the cathode being positioned: (a) on a face of the solid dielectric opposite the abutting faces, (b) adjacent the overhanging portion of the solid dielectric, and (c) so that the thickness of the solid dielectric is interposed between the anode and cathode; the voltage, anode, cathode and solid dielectric being arranged so that the bundle propagates from the cathode along the solid dielectric face opposite the abutting faces to an edge of the solid dielectric and thence across said edge to the anode.

16. The x-ray source of claim 10 wherein the x-rays emitted from the anode have a spot size small enough to be used for submicro lithography and for inspection of integrated circuit patterns.

17. The x-ray source of claim 14 wherein the container includes an electric contact connecting the liquid in the pool to the voltage source, the globule having a shape determined by the volume of the liquid in the pool relative to the container volume and independent of the contact.

18. The x-ray source of claim 14 wherein the x-rays have a flux density of approximately $10^{13}$ photons per 10 nanosecond in the 3 to 250 Kev range.

19. The x-ray source of claim 18 wherein the x-rays emitted from the anode have a spot size small enough to be used for submicro lithography and for inspection of integrated circuit patterns.

20. An electrical device comprising a chamber having a vacuum or an inert dielectric gas therein, the chamber including a cathode, an anode and a solid dielectric interposed between the cathode and anode so that the cathode and anode contact different portions of the dielectric, and a high voltage short duration pulse source connected between the anode and cathode; the anode, cathode, solid dielectric and duration and voltage of pulses from the source being such that in response to a pulse from the source being applied between the anode and cathode, a discrete contained charged particle bundle is formed at the cathode and propagates along a surface of the dielectric thence around the dielectric to the anode, the anode being fabricated of a metal that is heated in response to the bundle being incident thereon, and a load in heat transfer relation with the anode to be heated by heat from the anode.

21. The device of claim 20 wherein the load includes a fluid that is circulated through the anode to be heated by heat from the anode.

22. An electrical device comprising a chamber having a vacuum or an inert dielectric gas therein, the chamber including a cathode, an anode and a solid dielectric interposed between the cathode and anode so that the cathode and anode contact different portion of the dielectric, and a high voltage short duration pulse source connected between the anode and cathode; the anode, cathode, solid dielectric and duration and voltage of pulses from the source being such that in response to a pulse from the source being applied between the anode and cathode, a discrete contained charged particle bundle is formed at the cathode and propagates along a surface of the dielectric thence around the dielectric to the anode, the pulse source including: a DC power supply, a capacitor having first, second and third electrodes, the first electrode being located between the second and third electrodes and connected to the DC power supply to be charged by the supply, the second and third electrodes being respectively connected to the cathode and anode, a coil connected across the second and third electrodes, and spark gap breakdown discharge means for selectively connecting the first electrode to one of the second and third electrodes to establish a second discharge including the discrete contained charged particle bundle between the cathode and anode.

23. An electronic device comprising a cathode; an anode; and a solid dielectric interposed between the cathode and anode so that a path subsists along the solid dielectric between the cathode and anode, a voltage source connected between the anode and cathode; the voltage source, anode and cathode being such that a discrete contained charged particle bundle is formed at the cathode and propagates along the path to the anode; the cathode including a dielectric container having a liquid metal pool therein, an electrical contact in the container connecting the pool to the voltage source, the pool forming a globule extending out of the container and having a shape determined by the volume of the liquid in the pool relative to the container volume and independent of the contact, the globule having a surface contacting the solid dielectric.

24. The device of claim 23 wherein the liquid metal is mercury.

25. The device of claim 25 wherein the solid dielectric has an extended non-pointed surface area in contact with the globule, the extended surface area being greater than the surface area of the globule contacting the dielectric so the perimeter of the globule surface area contacting the solid dielectric is surrounded by the solid dielectric extended surface areas.

26. The device of claim 25 wherein the solid dielectric surface area contacting the globule extends horizontally and is contacted by an upper portion of the globule.

27. An electronic device comprising a source of periodic discrete contained charged particle bundles having a predetermined frequency, and a circuit ohmically connected to said source so that periodic current at the predetermined frequency resulting from derivation of the periodic discrete contained charged particle bundles flows in the circuit.

28. The device of claim 27 wherein the source includes: an anode, cathode and dielectric interposed between the anode and cathode, and a high voltage source for deriving pulses at said predetermined frequency connected between said anode and cathode so that said bundles propagate at said frequency between said anode and cathode.

29. The device of claim 28 wherein the circuit is connected in series with the anode, cathode and dielectric.

30. The device of claim 29 wherein the circuit is a tuned circuit having a resonant frequency equal to the predetermined frequency.

31. The device of claim 27 wherein the circuit is a tuned circuit having a resonant frequency equal to the predetermined frequency.

32. An energy converter comprising a source of discrete contained charged particle bundles traversing a path, means in said path for collecting the charged particle bundles and absorbing heat in response to the charged particle bundles being incident thereon, and means responsive to the heat absorbed by the absorbing means for performing useful work.

33. The energy converter of claim 32 wherein the source includes a cathode, anode and a solid dielectric interposed between the cathode and anode, the solid dielectric having a surface traversed by the charged particle bundles to define the path.

34. The energy converter of claim 33 wherein the anode comprises the means for collecting, the anode being formed of a metal that is substantially nonradiative of thermal and electromagnetic energy in response to the bundles being incident thereon.

35. The energy converter of claim 34 wherein the anode includes a passage through which heat exchange fluid flows to be heated in the anode by the heat absorbed by the anode from the bundles.

36. The energy converter of claim 33 wherein the solid dielectric includes an elongated gap defining a path for a group of the particles propagating simultaneously from the cathode to the anode, said group having a predetermined diameter, the gap having a dimension at right angles to the path equal approximately to the diameter of the group.

37. The energy converter of claim 36 wherein the cathode includes an edge substantially at right angles to the path and substantially aligned with the path, the anode including a wall substantially at right angles to the path and intercepting the bundles propagating along the path.

38. The energy converter of claim 37 wherein the cathode is configured as a disc having an axis so that said edge is a circumferential edge of the disc, the anode wall having a circular configuration coaxial with said axis and surrounding said edge, the gap being configured as a ring between the edge and wall.

39. The energy converter of claim 38 wherein the anode comprises the means for collecting, the anode being formed of a metal that is substantially nonradiative of thermal and electromagnetic energy in response to the bundles being incident thereon.

40. The energy converter of claim 39 wherein the anode includes a passage through which heat exchange fluid flows to be heated in the anode by the heat absorbed by the anode from the bundles.

41. The energy converter of claim 36 wherein the gap includes two opposed planar parallel solid dielectric end faces extending between the anode and cathode and spaced from each other by a distance approximately equal to the diameter of the group.

42. The energy converter of claim 41 wherein the cathode includes an edge substantially at right angles to the path and substantially aligned with the path, the anode including a wall substantially at right angles to the path and intercepting the path.

43. The energy converter of claim 42 wherein the cathode is configured as a disc having an axis so that said edge is a circumferential edge of the disc, the anode wall having a circular configuration coaxial with said axis and surrounding said edge, the gap being configured as a ring between the edge and wall.

44. The energy converter of claim 33 wherein the cathode and anode are located at spaced regions on the solid dielectric so that the path extends across a surface and around an edge of the solid dielectric.

45. The energy converter of claim 44 wherein the solid dielectric and anode are configured as plates having abutting faces such that a portion of the solid dielectric plate overhangs an edge of the anode plate and a portion of the anode plate overhangs the solid dielectric plate, the cathode being positioned: (a) on a face of the solid dielectric opposite the abutting faces, (b) adjacent the overhanging portion of the solid dielectric, and (c) so that the thickness of the solid dielectric is interposed between the anode and cathode; the voltage, anode, cathode and solid dielectric being arranged so that the bundle propagates from the cathode along the solid dielectric face opposite the abutting faces to an edge of the solid dielectric and thence across said edge to the anode.

46. The energy converter of claim 32 wherein the anode comprises the means for collecting, the anode being formed of a metal that is substantially nonradiative of thermal and electromagnetic energy in response to the bundles being incident thereon.

47. The energy converter of claim 46 wherein the anode includes a passage through which heat exchange fluid flows to be heated in the anode by the heat absorbed by the anode from the bundles.

48. An electronic device comprising a cathode; an anode; and a solid dielectric interposed between the cathode and anode so that a path subsists across a surface of the dielectric between the cathode and anode; a voltage source connected between the anode and cathode; the voltage source, anode and cathode being such that a group of discrete contained charged particle bundles having a predetermined diameter is formed at the cathode and simultaneously propagates along the surface of the dielectric to the anode; the solid dielectric including an elongated gap defining the path for the group, the gap having a dimension at right angles to the path equal approximately to the diameter of the group.

49. The electronic device of claim 48 wherein the cathode includes an edge substantially at right angles to the path and substantially aligned with the path, the anode including a wall substantially at right angles to the path and intercepting the path.

50. The electronic device of claim 48 wherein the cathode includes an edge substantially at right angles to the path and substantially aligned with the path, the anode including a wall substantially at right angles to the path and intercepting the path.

51. The electronic device of claim 48 wherein the gap includes two opposed planar parallel solid dielectric end faces extending between the anode and cathode and spaced from each other by a distance approximately equal to the diameter of the group.

52. The electronic device of claim 51 wherein the cathode includes an edge substantially at right angles to the path and substantially aligned with the path, the anode including a wall substantially at right angles to the path and intercepting the path.

53. The electronic device of claim 52 wherein the cathode is configured as a disc having an axis so that said edge is a circumferential edge of the disc, the anode wall having a circular configuration coaxial with said axis and surrounding said edge, the gap being configured as a ring between the edge and wall.

54. An x-ray source comprising a cathode; an anode; and a solid dielectric interposed between the cathode and anode so that a path subsists across a surface of the dielectric between the cathode and anode, a voltage source connected between the anode and cathode; the voltage source, anode and cathode being such that a discrete contained charged particle bundle is formed at the cathode and propagates along the surface of the dielectric to a predetermined surface region of the anode to be incident on the surface at a predetermined angle of incidence, the predetermined region of the anode being made of a material and being arranged so that x rays are emitted from the surface of the region at an angle generally opposite to the predetermined angle of incidence.

55. The x-ray source of claim 54 further including a vacuum chamber in which the cathode, anode and solid dielectric are located, and including means for transmitting out of the chamber x-rays emitted from the anode to be incident on a workpiece exterior to the chamber and a detector for said x-rays as incident on the workpiece.

56. The x-ray source of claim 54 further including a vacuum chamber in which the cathode, anode and solid dielectric are located, and including an x-ray film holder positioned to be responsive to x-rays emitted from the anode for calibration purposes.

57. The x-ray source of claim 54 wherein the x-rays have a flux density of approximately $10^{13}$ photons per 10 nanoseconds in the 3 to 250 Kev range.

58. The x-ray source of claim 57 wherein the x-rays emitted from the anode have a spot size small enough to be used for submicro lithography and for inspection of integrated circuit patterns.

59. The x-ray source of claim 54 wherein the x-rays emitted from the anode have a spot size small enough to be used for submicro lithography and for inspection of integrated circuit patterns.

* * * * *